US009248640B2

(12) United States Patent
Heng

(10) Patent No.: US 9,248,640 B2
(45) Date of Patent: Feb. 2, 2016

(54) METHOD AND APPARATUS FOR IMPROVING REGISTRATION AND SKEW END OF LINE CHECKING IN PRODUCTION

(71) Applicant: Intermec IP Corp., Everett, WA (US)

(72) Inventor: Too Mui Heng, Singapore (SG)

(73) Assignee: Intermec IP Corp., Everett, WA (US)

( * ) Notice: Subject to any disclaimer, the term of this patent is extended or adjusted under 35 U.S.C. 154(b) by 259 days.

(21) Appl. No.: 13/688,650

(22) Filed: Nov. 29, 2012

(65) Prior Publication Data

US 2013/0220157 A1 Aug. 29, 2013

Related U.S. Application Data

(60) Provisional application No. 61/567,804, filed on Dec. 7, 2011.

(51) Int. Cl.

| | |
|---|---|
| ***B41J 11/46*** | (2006.01) |
| ***B41F 1/34*** | (2006.01) |
| ***B41J 29/38*** | (2006.01) |
| ***B41F 33/00*** | (2006.01) |

(52) U.S. Cl.

CPC ..... *B41F 33/0081* (2013.01); *B41J 11/46* (2013.01); *B41P 2233/52* (2013.01)

(58) Field of Classification Search

CPC ..... B65H 2701/1241; B65H 2701/124; B65H 2701/1242; B65H 2701/12411; B65H 23/0204; B65H 23/046; B41J 11/46; B41J 11/64; B41P 2233/52; B41F 33/0081; B41F 1/34; B41F 13/025; G03G 2215/0161; B42D 15/0006

USPC ..... 101/481, 484, 485, 486, 181, 183; 400/619

See application file for complete search history.

(56) References Cited

U.S. PATENT DOCUMENTS

| | | | | |
|---|---|---|---|---|
| 4,857,715 | A * | 8/1989 | Koch et al. | 235/456 |
| 5,187,774 | A * | 2/1993 | Ericson | 358/1.12 |
| 2007/0025789 | A1 * | 2/2007 | Lee | 400/188 |
| 2012/0161396 | A1 * | 6/2012 | Munn | 273/348 |

OTHER PUBLICATIONS

Title: Office Depot grid paper; Date: Sep. 15, 2008; p. 4-5; URL: http://www.officedepot.com/a/products/853721/Office-Depot-Brand-Quadrille-Pad-8/.*

Title: EKG paper; Date: Aug. 29, 2000; p. 1; URL: http://www.rnceus.com/ekg/ekghowto.html.*

* cited by examiner

*Primary Examiner* — Daniel J Colilla
*Assistant Examiner* — Ruben Parco, Jr.
(74) *Attorney, Agent, or Firm* — Additon, Higgins & Pendleton, P.A.

(57) ABSTRACT

System, method, article for determining registration and/or skew errors in a print medium with respect to a printing element includes a print medium including a two-dimensional pattern including a grid within a geometric shape. The grid has a plurality of vertical and horizontal lines, the intersection of each forming a cross-hair defining an X-Y positional data point; the collection of data points defining a data set. The geometric shape is in the form of a two-dimensional target having a plurality of concentric rings; an innermost one enclosing at least one of the X-Y positional data points in the data set. The printing element provides a marker onto the print medium. The positional location of the marker with respect to the one of the at least one enclosed X-Y positional data point defines a directional displacement vector for correcting registration and/or skew error between the print medium and the printing element.

11 Claims, 5 Drawing Sheets

METHOD AND APPARATUS FOR IMPROVING REGISTRATION AND SKEW END OF LINE CHECKING IN PRODUCTION

TECHNICAL FIELD

This disclosure is directed to print registration and skew and more specifically to a quick and efficient way to measure print registration and skew in an "end of line" print production.

BACKGROUND

In a printing operation, the term "registration" is the alignment of a print medium with respect to a printing element, such as a thermal printhead, in the in-line or print-medium-conveying direction (x axis direction) and in the lateral or direction orthogonal to the print-medium-conveying direction (y axis direction). The term "skew" is the rotation of the print medium with respect to the printing element. In other words, "registration" is caused by longitudinal and/or horizontal offsets whereas "skew" is caused by rotational offsets.

Proper registration and skew alignment of a print medium with respect to a printing element is of considerable importance, especially for economical, high-speed, high-volume print reproduction. For example, in a continuous web of print medium, such as a label or sheet of paper, the continuous web of print medium may be fed past printing subsystems that form images by applying one or more colorants to the print medium. From label to label, or from sheet to sheet, on a continuous web it is important for the image to be printed on the print medium in the same place on every label or sheet on the continuous web and in each case in the precise area of the label or sheet where the image is intended to be displayed. Even with respect to a single label or sheet, when printing an image on that label or sheet involves more than one color, depending on the method of printing, it is necessary to print the image one separate time for each separate color, and alignment of each image with respect to the others is imperative. Hence, there is a need for precise registration and skew alignment each time an image is applied to the same or different print medium in a printing operation.

For this reason, at the start of a printing operation, and at predetermined times throughout, an operator may ensure that the registration and skew of the print medium with respect to the printing element are properly aligned. In the course of high-speed, high-volume print reproduction processes however, the alignment of print medium to printing element may experience a degradation over time due to frictional slippage of the print medium as it is being conveyed through the printer by rollers or other conveyance mechanisms during a printing operation. Other factors may contribute to the degradation of the alignment. For example, heat generated by the printer, vibration of the mechanical components, wear and tear of the mechanical components, and even discontinuities in the quality along a web of the print medium, as well as other factors, may contribute to a drift of the registration and skew of the print medium with respect to the printing element. As a consequence of such drift, images may be printed on the print medium that are not in alignment with the printing element; a problem that is unacceptable, especially where precision printing is required, such as in connection with the printing of instruments and tickets. For tickets and certified documents, for example, the location of every graphical structure is important, such as for use in detecting counterfeit labels. Every misalignment is a hint that something is wrong.

To locate a print medium accurately with respect to a printing element, an operator, or in the case of an automated printer, the printer itself, needs to know two criteria—namely where the print starts and where the print is to be located. The edge of the label or sheet of paper often provides the first criterion and the point at which the image is to be applied to the label or sheet of paper is often used to provide the second criterion.

In conventional manual alignment practices in the printing industry, a grid of vertical and horizontal lines, typically spaced 0.1 mm apart, may be provided on a template label or sheet of paper. The intersection of each one of the vertical and horizontal lines forms a cross-hair. The template label or sheet of paper may be individually inserted into the print station for the purpose of performing a print registration and skew alignment test. Alternatively, on a web of labels or sheets of paper, the template label or sheet may be interspersed on the web in between labels or sheets of paper destined for production printing for the purpose of periodically performing a print registration and skew alignment test during a print operation, manually or dynamically, every time the template label or sheet reaches the print station. To perform the registration and skew test, the printer applies a dark mark, such as a cross-hair, onto the test label or sheet with the grid. In a manual operation, the operator may then measure the position of the dark mark with respect to a reference point on the grid using a special ruler with 0.1 mm scale and a magnifying glass. In an automatic operation, the printer itself may make the measurement. The displacement of the cross-hair from the reference point on the grid represents the directional drift of the print medium on the conveyor belt with respect to the printing element. Manual or automatic correction of this displacement sets the registration and skew back into alignment.

Manual measurement of print registration and skew drift using the foregoing technique requires a visual observation and interpretation of the cross-hair to the reference point on a 0.1 mm scale which is imprecise, subjective, and introduces inconsistency in registration and skew alignment, depending upon the person taking the measurement. Automatic measurements of print and skew drift using the foregoing technique, albeit not subject to the impreciseness and subjectivity of a visual observation used in a manual method, is nonetheless limited by the precision afforded by the grid used on the template label or sheet of paper.

There is a need for improved registration and skew alignment of print medium to printing element and this disclosure provides one such improvement.

SUMMARY OF THE INVENTION

The disclosure provides a system and method for determining registration and/or skew errors in a print medium with respect to a printing element.

A system for determining registration and/or skew errors in a print medium with respect to a printing element includes a print medium including a two-dimensional pattern including a grid enclosed within a geometric shape. The grid has a plurality of vertical and horizontal lines, the intersection of each one of the vertical and horizontal lines forming a cross-hair defining an X-Y positional data point. The collection of the X-Y positional data points of each one of the vertical and horizontal lines of the grid define a data set useful for correcting a registration and/or skew error between the print medium and a printing element. The geometric shape is in the form of a two-dimensional target having a plurality of concentric circular rings. An innermost one of the plurality of concentric circular rings forms a bulls-eye. The bulls-eye encloses at least one of the X-Y positional data points in the data set, the cross-hair defining the at least one X-Y positional data point being located at or near the center of the bulls-eye. The printer places a marker onto the print medium for use in determining the registration and/or skew error between the print medium and the printing element. The positional location of the marker with respect to the cross-hair defining the at least one enclosed X-Y positional data point defines a directional displacement vector for correcting the registration and/or skew error between the print medium and the printing element.

The method for determining registration and/or skew errors in a print medium with respect to a printing element includes: providing a print medium including a two-dimensional pattern including a grid having a geometric shape. The grid has a plurality of vertical and horizontal lines, the intersection of each one of the vertical and horizontal lines forming a cross-hair defining an X-Y positional data point. The collection of the X-Y positional data points of each one of the vertical and horizontal lines of the grid define a data set useful for correcting a registration and/or skew error between the print medium and a printing element. The geometric shape is in the form of a two-dimensional target having a plurality of concentric circular rings. An innermost one of the plurality of concentric circular rings forms a bulls-eye. The bulls-eye encloses at least one of the X-Y positional data points in the data set, the cross-hair defining the at least one X-Y positional data point being located at or near the center of the bulls-eye. The method also includes using the printing element to place onto the print medium a marker for use in determining the registration and/or skew error between the print medium and the printing element. The method further includes determining a positional location of the marker with respect to the cross-hair defining the at least one enclosed X-Y positional data point, the position location defining a directional displacement vector for correcting the registration and/or skew error between the print medium and the printing element. The method further includes correcting the registration and/or skew error between the print medium and the printing element using the directional displacement vector.

DETAILED DESCRIPTION

Figure 1:
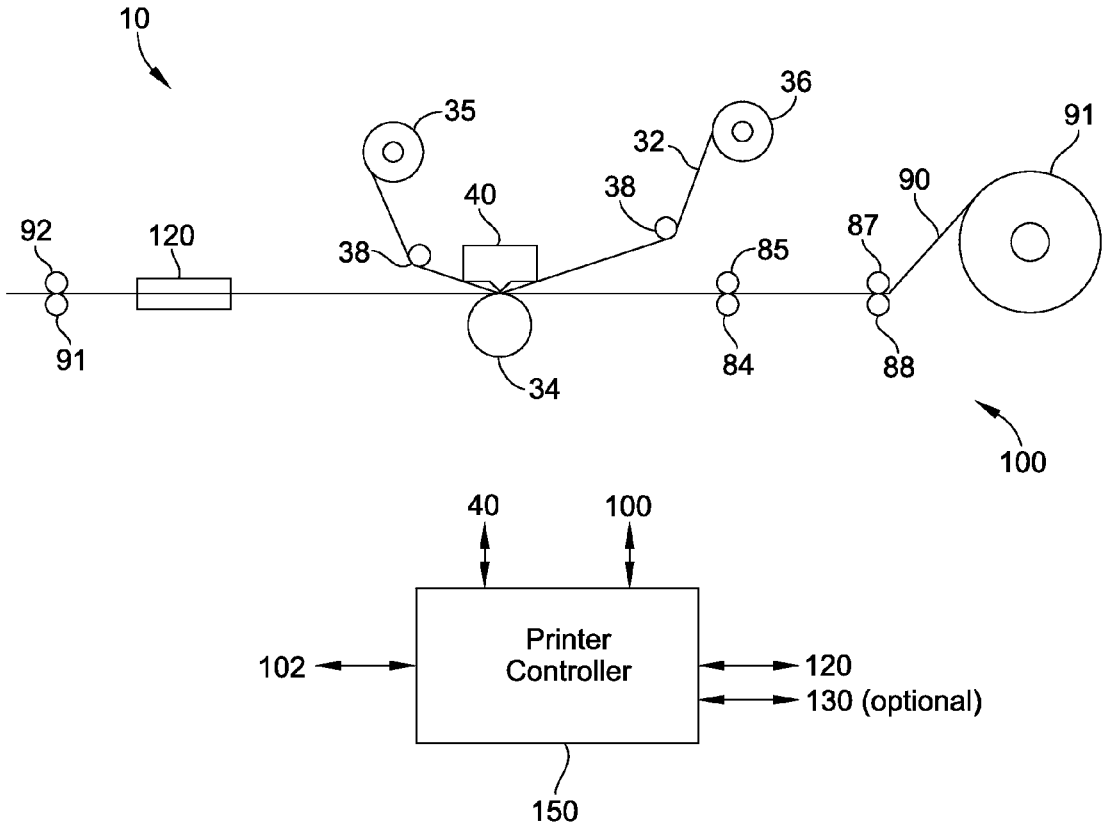
FIG. 1 is a schematic illustration of an exemplary disclosed thermal transfer printer.

FIG. 1 illustrates a thermal transfer printer 10 for applying a print image to a print medium 90 in accordance with a registration and skew alignment system and method of this disclosure. Print medium 90 may be any printable substrate such as a sheet of paper, plastic, or other suitable physical medium for printable text and images, whether precut or web fed. For labeling of products in inventory applications, for example, bar codes are often printed onto label stock of varying thicknesses and surface textures.

Printer 10 includes a printing portion 100, and a printer controller 150. The printing portion 100 includes a printing element 40, illustratively a thermal printhead, and a thermal transfer ribbon 32. In operation, the printing portion 100 prints on a surface of the print medium 90 taken from printer print medium supply 91 by melting a pattern of ink dots from the thermal transfer ribbon 32 onto the surface of the print medium 90 as the ribbon 32 and print medium 90 pass under the thermal printhead 40 under control of the printer controller 150.

The printing portion 100 further includes an elastomer-coated platen roller 34, which typically is driven by a stepping motor (not shown) to provide both a movement force for the ribbon 32 and print medium 90 by means of a friction drive action on the print medium 90, as well as acting as the receiver for the required pressure of the printhead 40 on the ribbon and print medium 90. This pressure assists in transferring the molten ink dots under printhead 40 from the thermal transfer ribbon 32 onto the surface of the print medium 90.

The printing portion 100 further includes a printer ribbon supply 36, a printer ribbon take-up spindle 35, and idler rollers 38. In operation, the thermal transfer ribbon 32 is unwound from the printer ribbon supply 36, and is guided under the thermal printhead 40 by idler rollers 38. After the ink is melted from the ribbon 32 onto the print medium 90, the spent ribbon is wound on the printer ribbon take-up spindle 35.

The printing portion 100 further includes rollers 84, 85, 87, 88, a means for print adjusting (not shown) the orientation of print medium 90 with respect to printerhead 40, and a registration and skew determination module 120. Rollers 84, 85, 87, 88 are components well known in their function and operation. The means for adjusting the orientation of print medium 90 with respect to printhead 40 may be a servomechanism (not shown) or manual control mechanisms (not shown) well known in the art in their function and operation.

Figure 2:
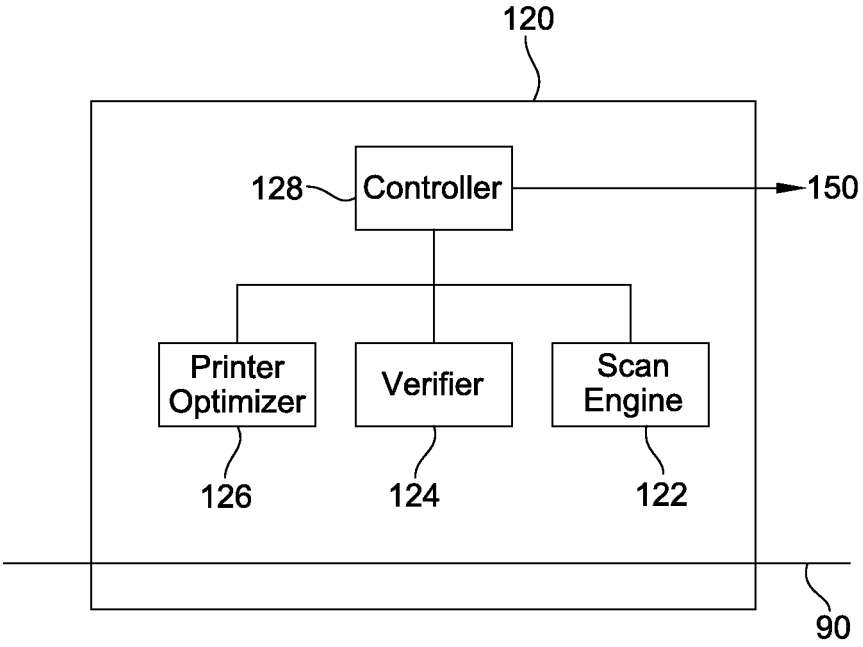
FIG. 2 is a functional block diagram of a registration and skew determination module 120.
Figure 3:
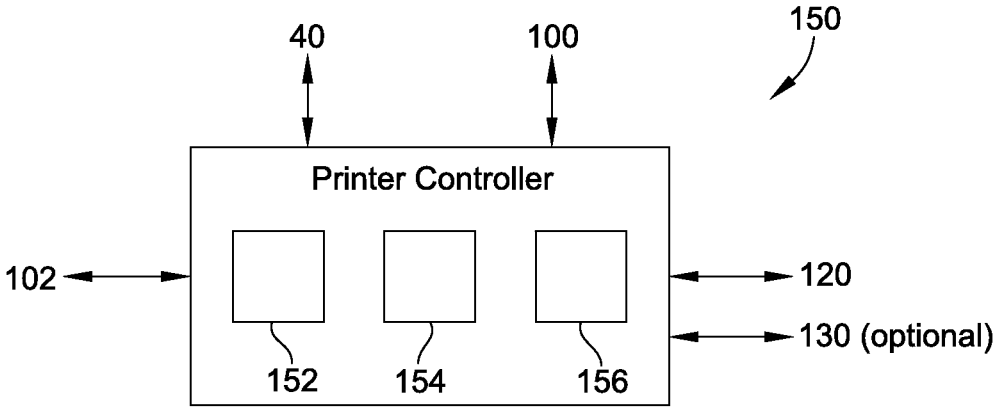
FIG. 3 is a functional block diagram of a printer controller 150.

As shown in FIG. 2, registration and skew determination module 120 illustratively includes a scan engine 122, a verifier 124, a printer optimizer 126, and a controller 128. Scan engine 122 refers to any device capable of converting a printed output image to data in an electronic form. Scan engines are well known in their function and operation. The scan engine 122 may be a laser, vidicon, charge-coupled device, or the like. The scan engine 122 generates electrical signals indicative of the output image. The verifier 124 receives the electrical signals from scan engine 122 and determines the quality of the output image. The operation of the verifier is well known in function and operation. The verifier generates an indicator of the image quality and passes the information to the printer optimizer 126. The printer optimizer 126 in turn adjusts the printer operating parameters to optimize the quality of the output image.

Controller 128 accepts commands from printer controller 150, parses the commands into logical format, and relays appropriate commands to the scan engine 122, verifier 124, and the optimizer 126. The controller 128 includes a microprocessor and memory (not shown). The operation of the controller 128 to process commands into a logical format is well known in the art in function and operation. Controller 128 may provide commands to printer controller 150 for activation of servomechanisms (not shown) of print medium adjustment means (not shown) for adjusting the orientation of print medium 90 with respect to thermal printhead 40. In the illustrative example, controller 128 is separate from printer controller 150. It will be appreciated though that controller 128 functions could be provided by the controller 150 printer controller.

Alternatively, registration and skew determination module 120 and the print adjustment means (not shown) may be a manual operation in which any misalignment may be detected visually and adjusted manually.

Printer controller 150 controls the operation of printer 10 and operations necessary for the image formation of thermal printhead 40. Printer controller 150 includes a processor 152, a memory 154 in which a control program executed by the processor is stored, and an input/output 156 for controlling an operation of printer 10. In an automated registration and skew alignment system, the memory 154 may store the instructions for execution by processor 152 to implement the process illustrated in FIG. 7. In a system having the registration and skew determination module 120 in which controller 128 is provided, the instructions associated with scan engine 122, verifier 124, and printer optimizer 126 may be stored in a memory (not shown) that may be associated with controller 128. These components and their operation are well known in the art. Printer controller 150 may generate and apply signals to the thermal printhead 40 and to motor drives (not shown) associated with the printing portion 100. For automatic realignment of any print registration or skew misalignment, processor 152 may generate and apply a correction signal to print adjustment means (not shown) responsive to signals received from registration and skew determination module 120 to adjust the orientation of print medium 90 with respect to thermal printhead 40.

When the image forming operation is started, the print medium 90 is conveyed to registration and skew determination module 120 via feed rollers 84, 85. At this time, the rollers 84, 85 are in a stopped state and the registration and skew of the print medium 90 may be determined and adjusted as described below. Thereafter, when the registration and skew feeding of the print medium 90 is corrected, the rollers 84, 85 are driven at a timing in which thermal printhead 40 is synchronized with an aligned position of the print medium 90.

Figure 4:
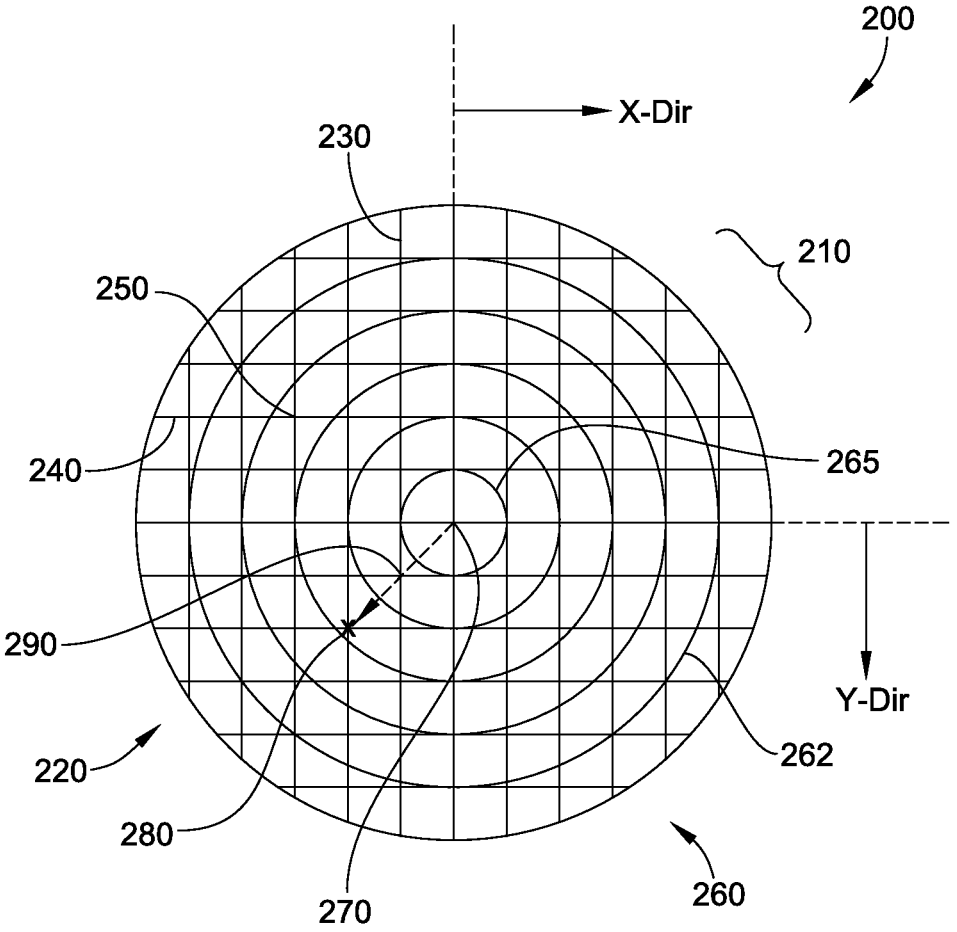
FIG. 4 is an illustrative two-dimensional pattern for use with a system for determining registration and skew errors in a print medium with respect to a printing element.

Print registration and skew correction according to the disclosure will now be described. FIG. 4 shows in detail a two-dimensional pattern 200 for use with printer 10 for determining registration and skew errors in a print medium with respect to printing element 40. As shown in FIG. 4, two-dimensional pattern 200 comprises a grid 210 within a geometric shape 220. Grid 210 comprises a plurality of vertical lines 230 and horizontal lines 240, the intersection of each one of said vertical and horizontal lines forming a cross-hair 250 defining an X-Y positional data point, the collection of said X-Y positional data points of each one of said vertical and horizontal lines of said grid defining a data set useful for correcting a registration and/or skew error between said print medium and a printing element. The geometric shape is in the form of a two-dimensional target 260 having a plurality of concentric circular rings 262, an innermost one of said plurality of concentric circular rings forming a bulls-eye 265. The bulls-eye encloses at least one of the X-Y positional data points 270 in the data set. The cross-hair 270 defining the at least one enclosed X-Y positional data point is located at or near the center of said bulls-eye.

FIG. 4 also shows a marker 280 provided by the printing element onto the print medium for use in determining the registration and/or skew error between said print medium and the printing element. Specifically, the positional location of marker 280 with respect to the cross-hair 270 that defines the at least one X-Y positional data point defines a directional displacement vector 290 for correcting the registration and/or skew error between the print medium and the printing element.

Illustratively, the grid size may be in the range of 0.5 mm to 2.0 mm The benefit is that different applications require different precision. The most strict applications require the tightest precision. For example, laser printers require a precision of 0.5 mm. In this case, the grid size may be 0.5 mm, about 0.5 mm, or less. For tickets and certified documents, for example, the location of every graphical structure is important such as for use in detecting counterfeit labels. Every misalignment is a hint that something is wrong. For a large size grid, such as 1.5 mm, the precision is less important. The operator can use the particular size grid based on application.

Figure 5:
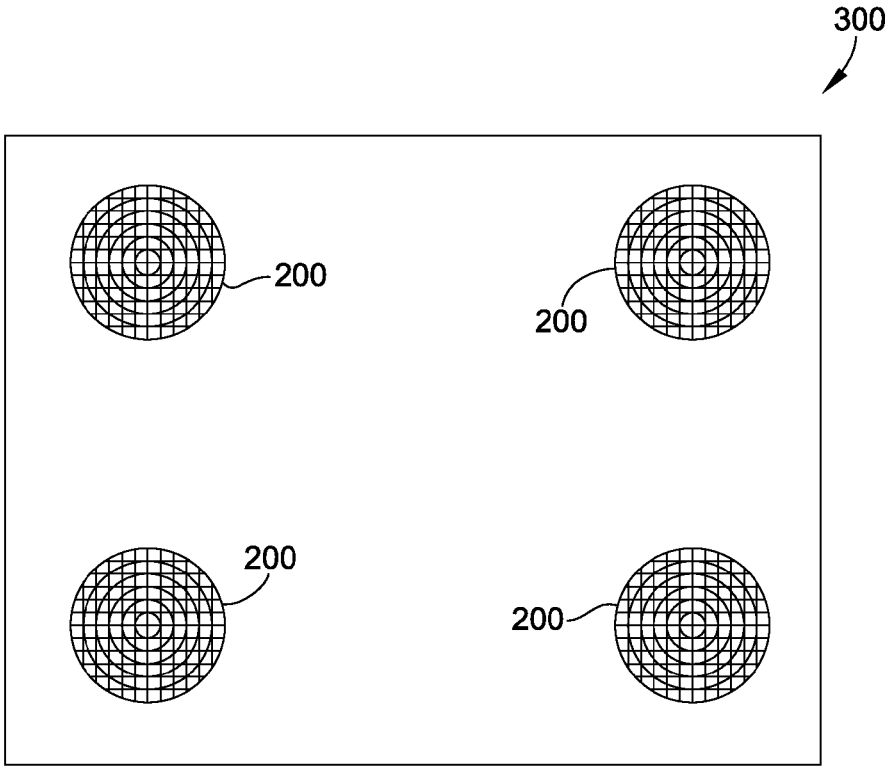
FIG. 5 is an illustrative use of four of the two-dimensional patterns of FIG. 4 on a template label or sheet of paper.

As shown in FIG. 5, illustratively four of these two-dimensional patterns 200 may be used on a template label or sheet 300, with each two-dimensional pattern 200 located in one of the four corners of the template label or sheet. A marker 280 shown in FIG. 4 may be applied by the printer to one or more of these two-dimensional patterns 200 shown in FIG. 5 to determine registration or skew error correction. By measuring the offsets from the center at each of the corners, it can be determined whether a registration or rotation of the sheet is causing the misalignment, and such a registration or rotation can be corrected. For example, where four markers 280 are applied, one to each of the four two-dimensional patterns 200, if each of the offsets from the center at each of the corners are parallel to each other, the offset may indicate a registration error and such a registration error can be corrected. If each of the offsets from the center are not all parallel, the print medium may have experienced a rotation and the skew error can be corrected.

In use, the template label or sheet may be individually inserted into the print station for the purpose of performing a print registration and skew alignment test. Alternatively, on a web of labels or sheets of paper, the template label or sheet may be interspersed on the web in between labels or sheets of paper destined for production printing for the purpose of periodically performing a print registration and skew alignment test during a print operation, manually or dynamically, every time the template label or sheet reaches the print station.

To perform the registration and skew test using template label or sheet 300, illustratively the printer applies a mark, such as cross-hair 280 shown in FIG. 4, onto the test label or sheet with the grid shown in FIG. 5 onto each of the four grids appearing on the label or sheet. The mark is placed in a pre-determined position on the test label or sheet (i.e., onto each of the four grids appearing on the label or sheet), such that in the absence of skew or registration errors the mark would be placed directly on the center of the grid. If each of the offsets from the center at each of the corners are parallel to each other, the offset may be a registration error alone (i.e., there is no skew error) and such a registration error can be corrected. If, however, the offsets from the center are not all parallel, the print medium may have experienced a rotation and the skew error can be accordingly corrected.

To perform a registration test alone using template label or sheet 300, illustratively the printer may apply a single mark, such as cross-hair 280 shown in FIG. 4, onto the test label or sheet with the grid shown in FIG. 5 onto one of the four grids appearing on the label or sheet. The mark is placed in a pre-determined position on the test label or sheet, such that in the absence of registration errors the mark would be placed directly on the center of the grid. A registration error may be detected by this single mark on this single grid appearing on the label or sheet alone. An error in rotation or skew on the other hand may require more than one mark on more than one grid as previously discussed. Hence, providing marks on multiple grids in FIG. 5 may be used to detect errors in skew. One or more of these marks may also be used to detect registration.

In a manual operation, the operator may then measure the position of the mark with respect to a reference point on the grid using the pre-printed grid as a grid ruler to obtain accurate and fast measurement data generally without needing to rely on special rulers to take the measurement. Specifically, this measurement would be a measurement of the number of grid spaces from the center by which the mark is offset in both the X and Y directions, providing the length and direction of directional displacement vector 290 shown in FIG. 4. In an automatic operation, the printer itself may make the measurement. The displacement of the cross-hair from the reference point on the grid represents the directional drift of the print medium on the conveyor belt with respect to the printing element. In other words, the positional location of the marker with respect to the X-Y positional data point enclosed by the bulls-eye defines a directional displacement vector for correcting the registration and/or skew error between the print medium and the printing element. Manual or automatic correction of the misalignment represented by the directional displacement vector (i.e., moving the adjustment means in a direction opposite to and in the amount represented by the directional displacement vector) sets the registration and skew back into alignment.

In the example shown in FIG. 4, directional displacement vector 290 is formed by moving two grid units in the downward direction and two grid units to the left in the horizontal direction. For a grid of scale 0.5 mm, this X-Y positional data point would be represented as:

(−2, −2) where each unit represents 0.5 mm distance

In absolute terms, the X-Y positional point translates to:

(−1 mm, −1 mm) absolute displacement from the bulls-eye 270

As another example, for a grid of scale 2 mm, the X-Y positional data point shown in FIG. 2 would again be represented as:

(−2, −2) where each unit represents 2 mm distance

In absolute terms, here the X-Y positional point translates to:

(−4 mm, −4 mm) absolute displacement from the bulls-eye 270

Hence, this disclosure provides a powerful tool for measuring registration and skew for use in aligning the print medium with the printing element. Moving the adjustment means (not shown) in a direction opposite to and in the amount represented by the calculated directional displacement vector sets the registration and skew back into alignment.

Figure 6:
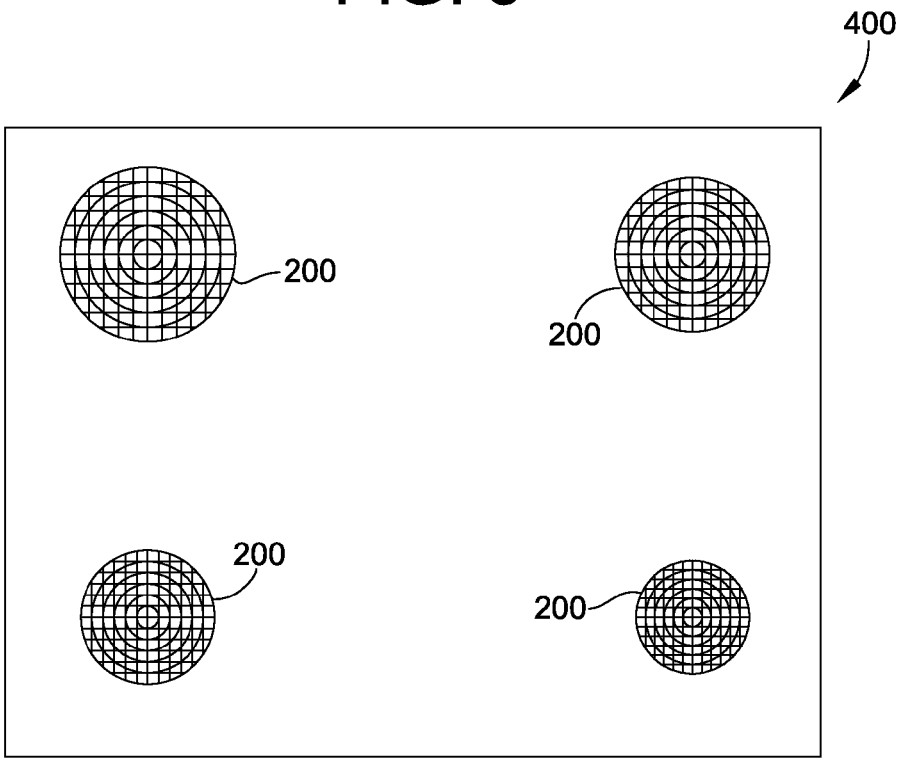
FIG. 6 is an illustrative alternative embodiment of a use of four of the two-dimensional patterns of FIG. 4 on a template label or sheet of paper.

FIG. 6 shows an illustrative disclosure of a plurality of the two-dimensional patterns 200 on a print label or sheet 400 for use with printer 10 for determining registration and skew errors between a label or sheet and printing element 40. As shown in FIG. 6, illustratively four of these two-dimensional pattern 200 may be used on a template label or sheet of paper with each two-dimensional pattern 200 located in one of the four corners of the template label or sheet of paper. Unlike in FIG. 5 where each of the four two-dimensional patterns 200 are of the same scale, the four two-dimensional patterns 200 shown in FIG. 6 are of four different scales (i.e., each grid is of a different scale). Alternatively, an arrangement where two of the patterns 200 may be of one scale and two of the patterns 200 may be of a different scale may be used as could an arrangement where three patterns 200 are provided of one scale with the fourth pattern 200 being of a different scale. Illustratively, the four two-dimensional patterns 200 shown in FIG. 4 are at 0.5 mm, 1.0 mm, 1.5 mm, and 2.0 mm scale, respectively. However, the grid size may be scaled to a dimension that is other than 0.5 mm, 1.0 mm, 1.5. mm, and 2.0 mm Illustratively, the scaling dimension falls within the range of 0.5 mm to 2.0mm but scaling dimensions outside of this range may also be used depending upon the printing application. The advantage of the label or sheet of paper with grid shown in FIG. 6 is that one label or print sheet may be used in four applications each of which require a different scale of grid; lending this label or print sheet to a wider application and further efficiencies in the printing operation. Depending on which scale of precision is required by the print operation, the printer would apply a mark, such as cross-hair 280 shown in FIG. 4, onto the test label or sheet with the grids shown in FIG. 6 onto the grid that provides the scale of precision required for the particular print operation. For a laser printer, for example, where precision on the scale of 0.5 mm may be required, the printer would apply the mark to the grid having the 0.5 mm scaling dimensions. The other three grids would not be marked in this test operation. The mark that is placed on the grid of choice would be placed in a pre-determined position on the test label or sheet (i.e., onto each of the four grids appearing on the label or sheet), such that in the absence of skew or registration errors the mark would be placed directly on the center of the grid.

While a label or sheet having grids of four scales as shown in FIG. 6 may be used to determine registration errors with different precision, the different scales of the grids however, may potentially reduce the accuracy of the detection of errors due to rotation of the page. More specifically, with grids having a different scale, the precision of the offset measurement taken from each grid may be different; thereby potentially reducing the accuracy from the comparison of these offsets to determine the skew error.

The correction of the printer registration and skew alignment by automatic process will now be discussed. When a template print-medium such as the label with grid or sheet with grid is conveyed to registration and skew determination module 120, printing element 40 applies the marker (or markers) to the print medium and scan engine 122 captures the image showing the position of the marker on the grid. The registration and skew determination module processes the captured image into a signal and detects the amount of registration and skew misalignment based on a calculation of the vector displacement of the location of the detected marker on the grid on the print medium which it applies to printer controller 150. More specifically, controller 128 of registration and skew determination module 120 determines the X and Y coordinates of the marker and calculates the vector displacement of these coordinates from the center of the grid or the bulls-eye. Alternatively, this calculation may be made by printer controller 150. The controller 128 then generates a correction signal that it provides to printer controller 150 which is applied to the print adjustment means (not shown) to drive the print medium and the printing element, in the illustrative example, a thermal printhead, back into alignment. The manner in which print adjustment means may bring the print medium and printhead back into alignment are well known in the art.

In an alternative embodiment, the registration and skew determination module detects the position of the grid on the print medium without the use of the marker. In this case, the grid captured by scan engine 122 is mapped onto a virtual grid stored in memory (not shown) for use by controller 128 in calculating the vector displacement and correction signal that is applied to print adjustment means to cause the print medium and printing element back into alignment. The virtual grid is a table that is stored in the memory.

Figure 7:
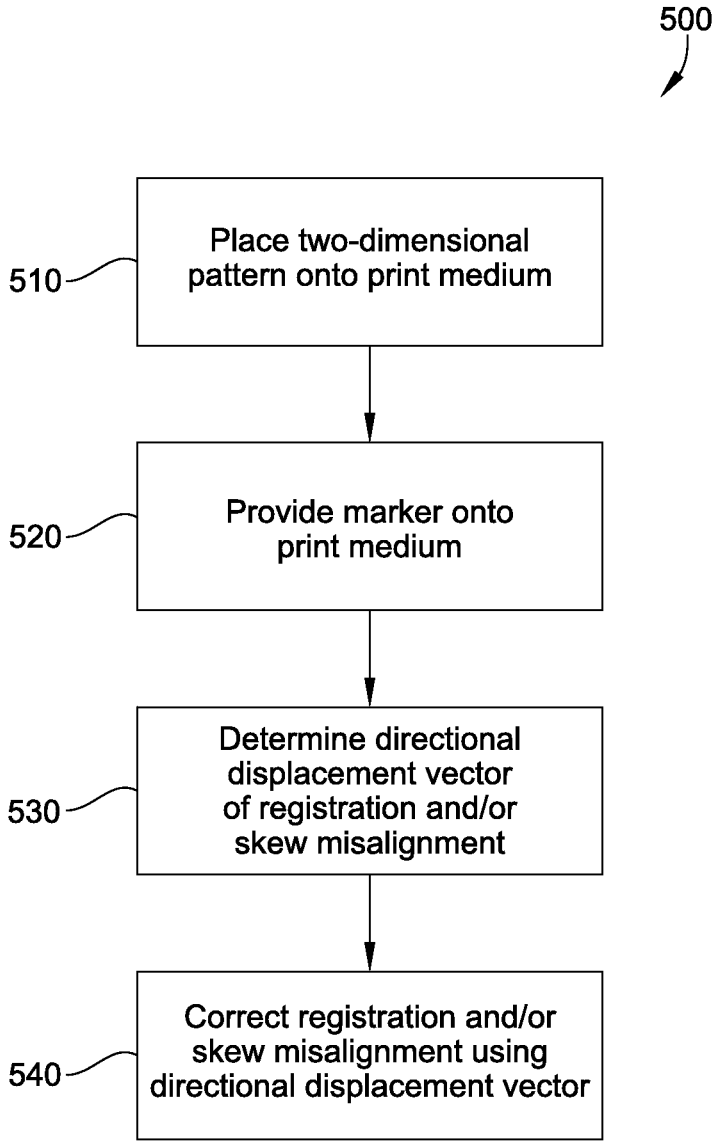
FIG. 7 is a flow diagram illustrating one embodiment of a process for determining registration and skew errors in a print medium with respect to a printing element.

FIG. 7 illustrates a flow chart of an exemplary embodiment of a process for determining registration and skew errors in a print medium with respect to a printing element. At 510, a two-dimensional pattern comprising a grid within a geometric shape is provided on a print medium. The grid has a plurality of vertical and horizontal lines, the intersection of each one of the vertical and horizontal lines forming a cross-hair defining an X-Y positional data point. The collection of the X-Y positional data points of each one of the vertical and horizontal lines of the grid define a data set useful for correcting a registration and/or skew error between the print medium and a printing element. The geometric shape is in the form of a two-dimensional target having a plurality of concentric circular rings. An innermost one of the plurality of concentric circular rings forms a bulls-eye. The bulls-eye encloses at least one of the X-Y positional data points in the data set, the cross-hair defining the at least one enclosed X-Y positional data point being located at or near the center of the bulls-eye. At 520, a marker (or markers) is placed by a printing element at a pre-defined position on the print medium for use in determining the registration and/or skew error between the print medium and the printing element. At 530, a positional location of the marker with respect to the one of the at least one enclosed cross-hair of the X-Y positional data point is determined The position location defines a directional displacement vector for correcting the registration and/or skew error between the print medium and the printing element. At 540, the registration and/or skew error between the print medium and the printing element is corrected using the directional displacement vector.

Industrial Applicability

The disclosed system and method may be applicable to registration and skew alignment of any print medium with respect to a printing element. The operation of the system will now be described.

With reference to the example printer shown in FIG. 1, the print medium 90 is first conveyed beneath the thermal printhead 40 and the printhead 40 prints one or more marks on the print medium for purposes of print registration and skew testing and then conveyed to the registration and skew determination module 120. At this time, the rollers 84, 85 may be put into a stopped state and a registration and/or skew test may be performed and the print medium adjusted for any registration or skew errors detected. If a registration and/or skew test is not required, print medium 90 passes registration and skew determination module 120 without stopping. Thereafter, the print medium 90 is conveyed beneath the thermal printhead 40 and the printing element 40 prints on a surface of the print medium 90 by melting a pattern of ink dots from the thermal transfer ribbon 32 onto the surface of the print medium 90. Thereafter, the print medium 90 is conveyed to a destination.

As previously indicated, once the print medium 90 including the pre-printed registration and skew error detection feature as described above advances to determination module 120, the print medium 90 may stop conveying and enter a stopped state for purposes of registration and skew testing. The testing is done on one or more markers previously applied to the print medium by the printhead. The registration and skew determination module 120 detects the position of the markers on the grid. One marker may be applied to one grid if the test is for registration. A plurality of markers may be applied, one each to a plurality of grids for a skew measurement; albeit a plurality of marks may also be applied, one each to a plurality of grids for a registration measurement. For a registration test using one mark, if the dark cross hairs lie on or in very close proximity to the bulls-eye of the grid, the print medium is in registration with the printing element. For a registration and/or a skew test using a plurality of markers, the offset of each marker may be indicative of registration or skew error. This is because the cross-hairs represent the position of the printing element with respect to the print medium and alignment of the cross-hairs with the bulls-eye on the print medium indicates that the print medium is positioned where it needs to be positioned for the image to be printed in the intended location on the print medium. If, however, the dark cross-hairs hit the circular targets anywhere other than the bulls-eye, the print medium is not in registration and/or skew alignment with the printing element and requires adjustment. The vector displacement of the cross-hairs from the bulls-eye is an indication of the correction that is required to be made in order for the image to be printed in the intended location on the print medium.

Determining the alignment of the cross-hairs with the bulls-eye may be done manually. In this case, the grid printed in the pre-printed registration and skew error detection feature permits a user to rapidly and accurately manually determine the X and Y coordinates of the cross-hairs with respect to the bulls-eye, generally without relying on slow or labor-intensive manual processes, such as using a ruler and magnification. These coordinates may then be used to calculate the vector displacement of the cross-hairs from the bulls-eye. The operator may then make manual adjustments to realign the print medium and the printing element in the amount of the displacement.

Alternatively, the operator may use a keypad (not shown) associated with a control panel (not shown) on printer 10 to enter the correction vector or the correction coordinates into the controller 150 for automatic adjustment of the registration and skew adjustment means, for use by the controller in generating a correction signal that it applies to adjustment means (not shown) to drive the print medium and printing element back into alignment.

For a fully automated registration and skew module, the process of determining the alignment of the cross-hairs with the bulls-eye may be done by the controller such as controller 128 shown in FIG. 2. In this case, the scan engine 122 in the determination module 120 captures the image of the cross-hair on the grid and processes the image into a signal which is applied to controller 128. Using the verfier 124 and printer optimizer 126, the controller detects the amount of registration and skew misalignment based on a calculation of the vector displacement of the location of the detected marker on the grid on the print medium. More specifically, the processor determines the X and Y coordinates of the marker and calculates the vector displacement of these coordinates from the point of normal alignment. The processor then generates a correction signal that it applies to the adjustment means to drive the print medium and printing element back into alignment.

In an alternative embodiment, the registration and skew determination module detects the position of the grid on the print medium without the use of the marker 280. In this case, the detected grid is mapped onto a virtual grid stored in memory 154 (or a memory associated with controller 128) to calculate the vector displacement and correction signal that is then applied to the adjustment means to drive the print medium and printing element back into alignment. The virtual grid may be represented by a table that is stored in the memory 154.

In an illustrative embodiment, the print medium is a print label or a sheet or paper. However, the disclosure is not limited to print labels and sheets of paper, and covers any print medium including plastic, or other suitable physical media or other suitable physical media for printable text and/or images, whether precut or web fed. The printing element 40 is illustratively a thermal printhead. However, the disclosure is not limited to a thermal printhead; rather the term print element means any element of a printer that applies a mark or image to the print medium. The printer is illustratively a thermal transfer printer. However, the disclosure is not limited to thermal transfer printers and covers any printer including ink jet printers, laser printers, direct thermal printing, electrostatic printing, and lithographic printing. The determination module is illustratively automated using a scanner or done manually. However, the disclosure is not limited to a determination module being a scanner and covers any automatic image capture and process system, including a raster imager. The registration and skew of the print media is illustratively determined and adjusted while the registration rollers 84, 85 are in a stopped state. However, the disclosure is not so limited. The disclosure may be used to determine and adjust registration and skew of the print medium without stopping the conveyance of the print medium (e.g., active registration and skew alignment correction). The marker used in the illustrative examples is a cross-hair. However, the disclosure is not limited to a marker being a cross-hair and covers any marker printed on the pre-printed grid-based registration and skew error detection feature described above.

While the printer is shown as including rollers 84, 85, 87, 88, 91, 92, as well as platen roller 34, it will be understood that the rollers that are used depend on the design of the printer. For example, in some embodiments, it may be possible to eliminate the rollers 84 and 85 with their function being handled by the platen roller 34.

It will be apparent to those skilled in the art that various modifications and variations can be made to the disclosed registration and skew alignment system and method. Other embodiments will be apparent to those skilled in the art from the consideration of the specification and practice of the disclosed system and method. It is intended that the specification and examples be considered as exemplary only, with a true scope being indicated by the following claims and their equivalents.

What is claimed is:

1. A system for use in determining registration and/or skew errors in a print medium with respect to a printing element, the system comprising:

a processor;

the print medium including a two-dimensional pattern comprising a grid within a geometric shape; said grid having a plurality of vertical and horizontal lines, an intersection of each one of said vertical and horizontal lines forming a cross-hair defining an X-Y positional data point, a collection of said X- Y positional data points of each one of said vertical and horizontal lines of said grid defining a data set useful for correcting a registration and/or skew error between said print medium and said printing element;

said geometric shape being in the form of a two-dimensional target having a plurality of concentric circular rings, an innermost one of said plurality of concentric circular rings forming a bulls-eye, said bulls-eye enclosing at least one of said X-Y positional data points in said data set, a center cross-hair defining an enclosed X-Y positional data point being located at or near the center of said bulls-eye;

said printing element is for placing a marker onto said print medium for use in determining said registration and/or skew error between said print medium and said printing element;

wherein the positional location of said marker with respect to said center cross-hair defining said at least one enclosed X-Y positional data point defines a directional displacement vector for correcting said registration and/or skew error between said print medium and said printing element;

wherein the positional location of said marker with respect to said center cross-hair of said at least one X-Y positional data point defining said directional displacement vector is determined by the processor.

2. The system of claim 1 wherein the printing element is a thermal printhead.

3. The system of claim 1 wherein a scale of said grid is in the range of 0.5 mm to 2.0 mm.

4. The system of claim 1 where a scale of said grid is 0.5 mm or less.

5. The system of claim 1 wherein said print medium is selected from a group consisting of a label, a sheet of paper, plastic, and other physical media for printable text or images.

6. The system of claim 1 wherein said printing element is used with a printer selected from a group consisting of a laser printer, a jet printer, a thermal transfer printer, an electrostatic printer, and a lithographic printer.

7. The system of claim 1 wherein said print medium includes a plurality of said two-dimensional patterns.

8. The system of claim 1 wherein said printing element places a plurality of markers onto said print medium for use in determining said registration and/or skew error between said print medium and said printing element.

9. The system of claim 7 wherein respective grids of at least two of said plurality of said two-dimensional patterns are of a different scale.

10. The system of claim 7 wherein said plurality of said two-dimensional patterns comprises four two dimensional patterns located in each of the four corners of said print medium.

11. The system of claim 10 wherein respective grids in each of said four two dimensional patterns is of a different scale taken from a group consisting of 0.5 mm, 1.0 mm, 1.5 mm, and 2.0 mm.

* * * * *